United States Patent [19]

Ortloff

[11] Patent Number: 4,529,334

[45] Date of Patent: Jul. 16, 1985

[54] PRODUCTION RISER ASSEMBLY

[75] Inventor: John E. Ortloff, Houston, Tex.

[73] Assignee: Exxon Production Research Co., Houston, Tex.

[21] Appl. No.: 575,103

[22] Filed: Jan. 30, 1984

[51] Int. Cl.[3] ..... E21B 17/01

[52] U.S. Cl. ..... 405/195; 405/202; 166/367

[58] Field of Search ..... 405/195, 203–208, 405/224–227; 166/350, 359, 362, 363, 367; 175/5, 7

[56] References Cited

U.S. PATENT DOCUMENTS

| | | | |
|---|---|---|---|
| 3,142,343 | 7/1964 | Otteman et al. | 166/355 X |
| 3,472,032 | 10/1969 | Howard | 166/359 X |
| 3,563,042 | 2/1971 | Ryan | 405/202 |
| 3,601,187 | 8/1971 | Tidwell | 166/5 |
| 3,782,458 | 1/1974 | Slack | 166/355 |
| 3,999,617 | 12/1976 | Ilfrey et al. | 175/7 |
| 4,155,670 | 5/1979 | Stafford | 405/202 |
| 4,248,549 | 2/1981 | Gzerewaty | 405/195 X |
| 4,279,544 | 7/1981 | Brun et al. | 405/202 |

FOREIGN PATENT DOCUMENTS

| | | | |
|---|---|---|---|
| 2802054 | 7/1979 | Fed. Rep. of Germany | 166/350 |

*Primary Examiner*—Dennis L. Taylor
*Attorney, Agent, or Firm*—Richard F. Phillips

[57] ABSTRACT

A production riser assembly includes a controlled bending guide and base assembly having a curved bend control surface which cooperates with a tension and bend shaft member associated with a riser pipe, whereby movement of the riser pipe is controlled by the movement of the tension and bend shaft member into an abutting relationship with a portion of the bend control surface of the guide and base assembly.

52 Claims, 15 Drawing Figures

FIG. 8
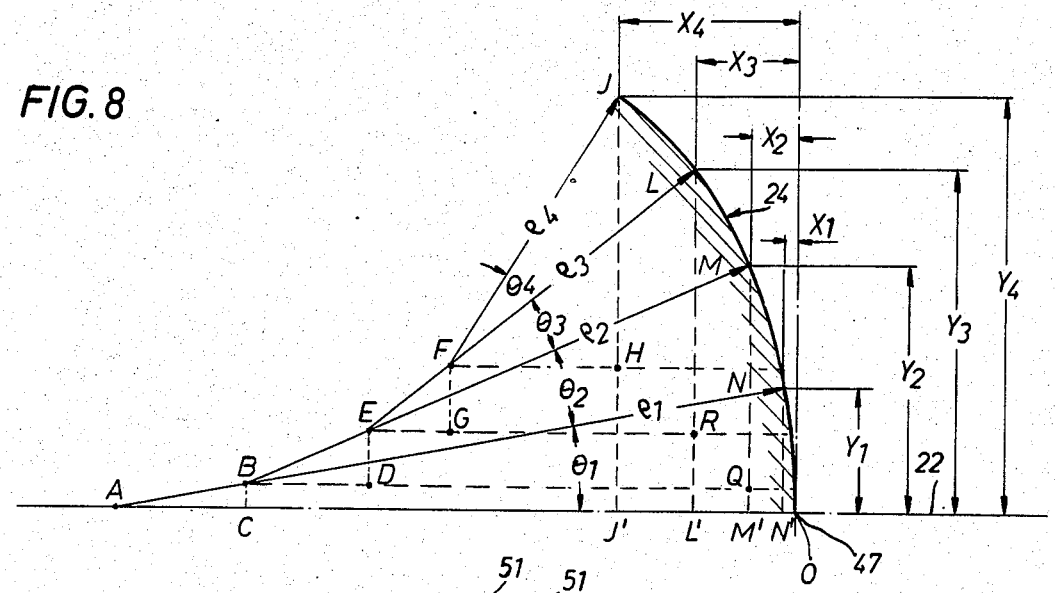
FIG. 4
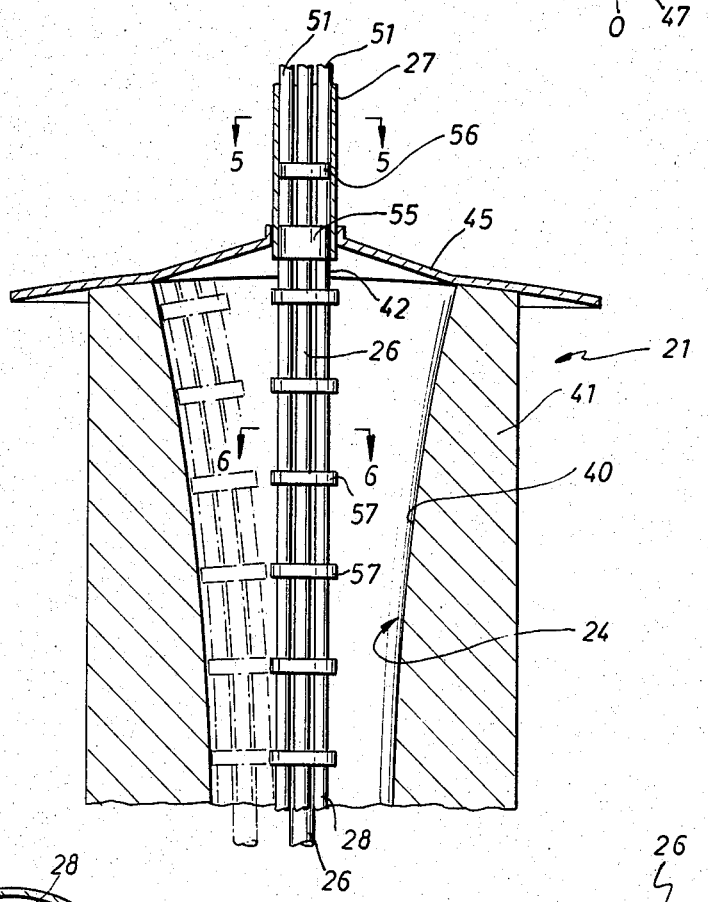
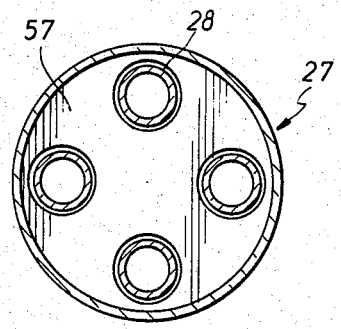
FIG. 5
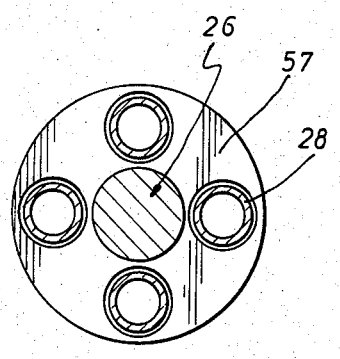
FIG. 6

PRODUCTION RISER ASSEMBLY

FIELD OF THE INVENTION

The invention relates to a production riser assembly for providing fluid communication between flowlines submerged in a body of water and a fluid storage means, such as a production and storage vessel, disposed adjacent the upper surface of the body of water.

BACKGROUND OF THE INVENTION

Most offshore hydrocarbon production operations carried out in deep water are conducted from floating vessels, such as a production and storage vessel. Once an offshore well begins producing hydrocarbons, it is necessary to provide for the transmission of the produced hydrocarbons from a wellhead at the ocean floor to the production and storage vessel. Typically, a plurality of flowlines from one well, or a plurality of offshore wells, are connected to a production and storage vessel via a marine riser, or riser pipe, which has associated therewith a plurality of riser flowlines.

One problem associated with such marine risers is the potential for structural failure caused by horizontal movement of the production and storage vessel from the vertical centerline from the point on the ocean floor where the submerged flowlines are connected to the marine riser. Wind, waves, and currents generally cause some vessel movement during production operations, even though the vessel is properly moored. It is therefore necessary to increase the flexibility of the large diameter, relatively stiff riser, to prevent riser failure. Typically, one or more flexible joints are placed intermediate the ends of the riser in order to increase riser flexibility. Another approach generally followed has been to attach the upper end of the marine riser to the production vessel by means of a pivotal connection and to join the lower end of the riser to the ocean floor via a universal joint disposed on the ocean floor. The submerged flowlines are typically connected to the universal joint supported riser by a plurality of elastomer-dependent flexible components such as hoses and/or swivels. The use of either flexible joints in the riser or a universal joint on the ocean floor to support the riser allows the riser to move due to movement of the production and storage vessel, as well as from forces exerted upon the riser itself by wind, waves, and/or water currents.

However, certain disadvantages result from the use of such flexible joints in the riser and/or a universal joint on the ocean floor. For example, flexible risers are subject to failure in deep water because of overstress and fatigue, in that tension must be applied to the riser to prevent it from buckling and the tension which must be applied increases rapidly with depth. In addition, stress levels induced within the riser by currents and the like, also increase with depth, although at a somewhat lower rate than the tensile load. These increased stress levels coupled with the cyclic variation in stresses caused by vessel movement may lead to accelerated fatigue failure.

With respect to the use of a universal joint on the ocean floor, a major disadvantage is associated with the required size and structural strength for such a universal joint. Further, the use of such universal joints requires the use of elastomer-dependent flexible components which are more quickly subject to failure than metal components. When such components do fail, it is necessary to use an expensive underwater maintenance vehicle, such as a tethered maintenance vehicle, to service and/or replace such components, as well as to connect such components to the marine riser in the first instance.

Accordingly, prior to the development of the present invention, there has been no production riser assembly for providing fluid communication between at least one flowline submerged in a body of water and a fluid storage means disposed adjacent the upper surface of the body of water, which does not require: flexible joints disposed along the length of the riser pipe; the use of a large and structurally strong universal joint on the ocean floor; the use of elastomer-dependent flexible components, such as hoses and/or swivels to connect the submerged flowline to the riser; and an expensive maintenance vehicle to install, service, and/or repair such elastomer-dependent flexible components.

Therefore, the art has sought a production riser assembly for providing fluid communication between at least one flowline submerged in a body of water and a fluid storage means disposed adjacent the upper surface of the body of water which does not require: a flexible joint in the marine riser; the use of a large universal joint on the ocean floor; the use of elastomer-dependent flexible components to connect the submerged flowline to the marine riser; and the use of an expensive maintenance vehicle to repair, install, and/or service the connections between the submerged flowline and the marine riser.

SUMMARY OF THE INVENTION

In accordance with the invention, the foregoing advantages have been achieved through the present production riser assembly for providing fluid communication between at least one flowline submerged in a body of water and a fluid storage means disposed adjacent the upper surface of the body of water. The present invention includes: a controlled bending guide and base assembly disposed adjacent the lower surface of the body of water and having a curved bend control surface and a base associated therewith; a tension and bend shaft member having upper and lower ends, the lower end being fixedly secured with respect to the guide and base assembly, the shaft member being disposed adjacent the bend control surface of the guide and base assembly; an elongate riser pipe, having upper and lower ends, the lower end being associated with the upper end of the shaft member and the upper end being associated with the fluid storage means; and at least one connector flowline in fluid communication between the submerged flowline and the fluid storage means whereby upon forces, either from the body of water or the movement of the fluid storage means, being exerted upon the riser pipe, movement of the riser pipe within the body of water is controlled by the movement of the tension and bend shaft member into an abutting relationship with a portion of the bend control surface of the guide and base assembly. A feature of the present invention is that the curved bend control surface of the guide and base assembly has upper and lower ends and may have a non-varying radius of curvature along the longitudinal axis of the curved bend control surface. A further feature of the present invention is that the curved bend control surface of the guide and base assembly may have upper and lower ends and may have a varying radius of curvature along the longitudinal axis of the curved bend control surface.

Another feature of the present invention is that the tension and bend shaft member may comprise a plurality of spiralled, intertwined cylindrical rod members. An additional feature of the present invention is that the riser pipe may have adjacent the upper end of the tension and bend shaft member a means for weighting the lower end of the riser pipe to reduce or eliminate tension forces acting upon the tension and bend shaft member.

The present invention also includes a controlled bending guide and base assembly for use in a production riser assembly for providing fluid communication between at least one flowline submerged in a body of water and an elongate riser pipe having upper and lower ends, the upper end thereof being in fluid communication with a fluid storage means disposed adjacent the upper surface of the body of water. This controlled bending guide and base assembly of the present invention includes: a base having a curved bend control surface associated therewith; a tension and bend shaft member having upper and lower ends, the lower end being fixedly associated with the base, and being disposed adjacent the bend control surface, and the upper end is free to move and is adapted to be connected to the riser pipe; and at least one connector flowline associated with the base and adapted for fluid communication between the submerged flowline and the riser pipe; whereby upon forces, either from the body of water or the movement of the fluid storage means, being exerted upon the riser pipe and transmitted to the tension and bend shaft member, movement of the riser pipe within the body of water is controlled by the movement of the tension and bend shaft member into an abutting relationship with a portion of the curved bend control surface of the base.

The production riser assembly and controlled bending guide and base assembly of the present invention, when compared with marine risers having flexible joints or which utilize a universal joint on the ocean floor, have the advantages of eliminating: the necessity of a large universal joint; the need for elastomer-dependent flexible components; and the need for servicing, installing, and/or replacing components for connecting the submerged flowline to the marine riser by use of an expensive tethered maintenance vehicle.

BRIEF DESCRIPTION OF THE DRAWINGS

In the drawings

FIG. 4 is a partial cross-sectional view of another embodiment of the controlled bending guide and base assembly for use in a production riser assembly in accordance with the present invention;

FIG. 5 is a cross-sectional view taken along line 5—5 of FIG. 4;

FIG. 6 is a cross-sectional view taken along line 6—6 of FIG. 4;

FIG. 8 is a schematic representation illustrating the varying radius of the curved bend control surface of the production riser assembly in accordance with the present invention;

While the invention will be described in connection with the preferred embodiment it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 1:
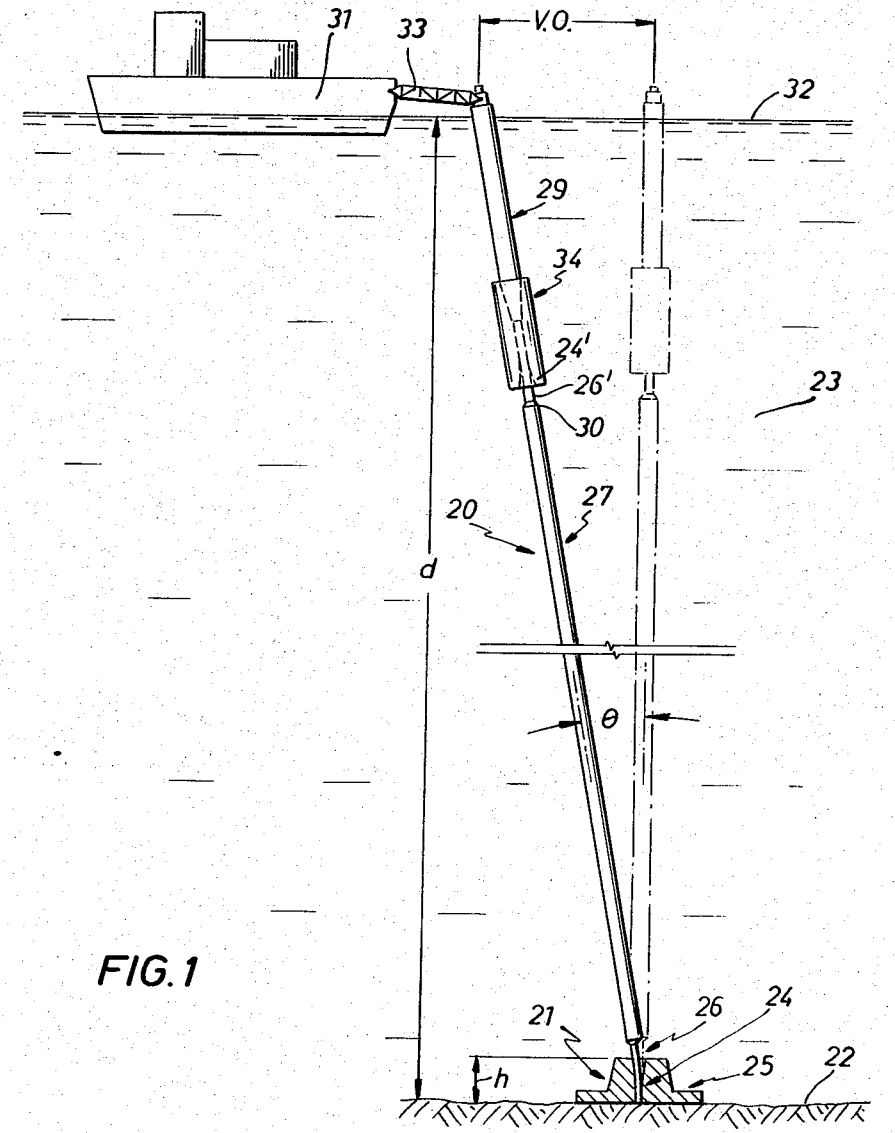
FIG. 1 is a schematic representation of an offshore hydrocarbon production operation illustrating the production riser assembly in accordance with the present invention.
Figure 2:
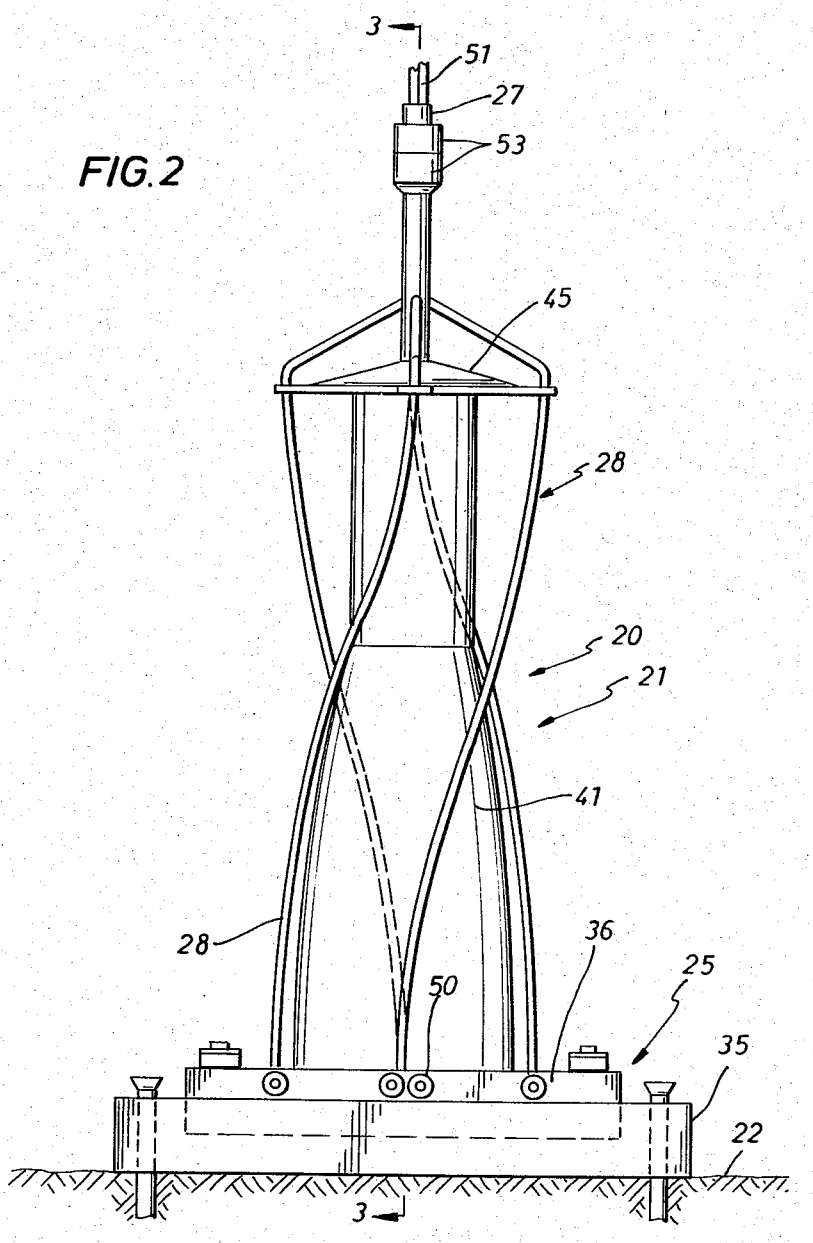
FIG. 2 is a front view of one embodiment of the controlled bending guide and base assembly for use in a production riser assembly in accordance with the present invention.

In FIG. 1, the production riser assembly 20 of the present invention is illustrated, and is shown to generally comprise: a controlled bending guide and base assembly 21 disposed adjacent the lower surface 22 of a body of water 23, and having a curved bend control surface 24 (FIG. 4) and a base 25 associated therewith; a tension and bend shaft member 26; an elongate riser pipe 27 and at least one connector flowline 28 (FIG. 2). A conventional mooring buoy 29 may be associated with the upper end 30 of the riser pipe 27, and a conventional fluid storage means, or production and storage vessel 31, is disposed adjacent the upper surface 32 of the body of water 23. Vessel 31 is associated with the mooring buoy 29 via a conventional articulated bridge arm 33. FIG. 1 also illustrates the use of an optional bend control guide 34, to be hereinafter described, which may be utilized with mooring buoy 29 and elongate riser pipe 27. In FIG. 1, the disposition of production riser assembly 20 is illustrated in dotted lines when no forces, such as from wind, water currents, weather conditions, etc., have been exerted upon the production and storage vessel 31, mooring buoy 29, and/or the riser pipe 27. The position of the production and storage vessel 31, riser pipe 27 and mooring buoy 29 are illustrated in FIG. 1 in solid lines when the foregoing forces have caused relative movement between the production and storage vessel 31 and riser pipe 27 and the controlled bending guide and base assembly 21. The angle $\theta$ illustrated in FIG. 1 denotes the amount of angular deflection, or offset, of the production and storage vessel 31 and riser pipe 27 from the normal disposition thereof, as illustrated in dotted lines in FIG. 1. As will be hereinafter described in greater detail, by utilizing the production riser assembly 20, in accordance with the present invention, it is possible to allow the production and storage vessel 31 to react to the forces exerted upon it offshore, whereby production and storage vessel 31 may move outwardly from its normal position, shown in dotted lines, through an angle of deflection $\theta$ without overstressing the tension and bend shaft member 26 and/or riser pipe.

Figure 3:
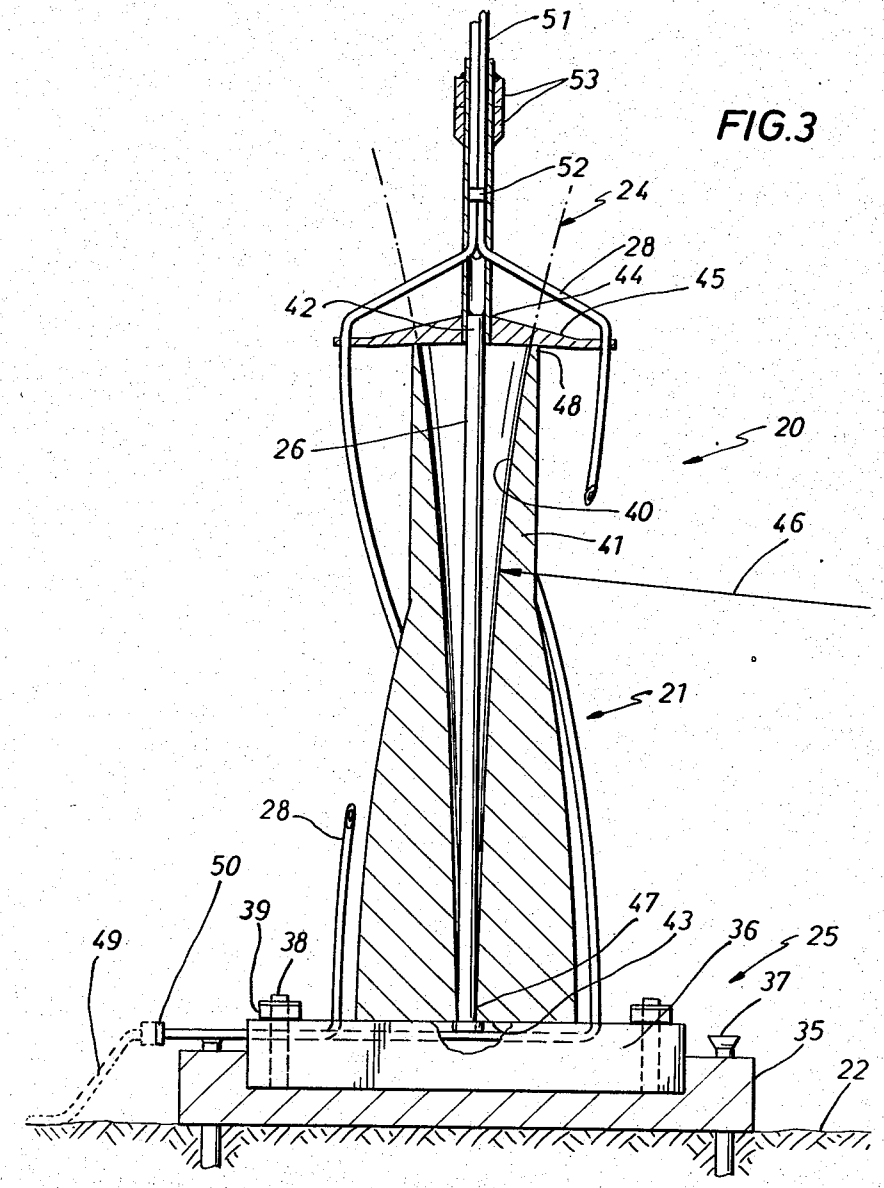
FIG. 3 is a partial cross-sectional view along line 3—3 of FIG. 2.

With reference now to FIGS. 2 and 3, one embodiment of the production riser assembly 20 of the present invention will be described in greater detail. Controlled bending guide and base assembly 21 is disposed adjacent the ocean floor 22 and its base 25 is fixedly secured thereto via primary base 35 and sub-base member 36. Base 35 is typically secured to the ocean floor as by a plurality of conventional piles 37 and sub-base 36 is fixedly secured to base 35 as by a plurality of connector posts 38 associated with base member 35 and a plurality of remote connectors 39 associated with sub-base member 36. After primary base 35 is fixedly secured to the ocean floor 22, in any conventional manner, the controlled bending guide and base assembly 21, including sub-base 36 may then be lowered in any conventional manner and secured to base 35 via connector posts 38 and remote connectors 39. As seen in FIGS. 2 and 3, curved bend control surface 24 of the controlled bending guide and base assembly 21 may be formed by a continuous, integral, interior surface 40 of a bending control cone 41 mounted upon sub-base 36.

Further, with reference to FIGS. 2 and 3, it is seen that the tension and bend shaft member 26 has upper and lower ends 42, 43, and the lower end 43 is fixedly secured with respect to the guide and base assembly 21, as by welding to the sub-base 36. Tension and bend shaft member 26 is disposed adjacent the curved bend control surface 24, and is preferably disposed in a spaced, concentric relationship with respect to the interior surface 40 of bending control cone 41. The upper end 42 of tension and bend shaft member 26 is associated with the lower end 44 of elongate riser pipe 27. An optional debris cover 45 may be provided at the upper end of bending control cone 41 to preclude the entry of debris into the interior of bending control cone 41. As will be hereinafter described in greater detail, the curved bend control surface 24, or interior surface 40 of bending control cone 41, flares upwardly and outwardly from the lower end 43 to the upper end 42 of tension and bend shaft member 26. The diameter of the conical bend control interior surface 40 at the lower end 43 of tension and bend shaft member 26 may closely approximate the outer diameter of the tension and bend shaft member 26. Arrow 46 in FIG. 3 represents the radius of curvature of the curved bend control surface 24, and as illustrated in FIG. 3 the radius of curvature for the bend control surface 40 illustrated has a non-varying radius of curvature along the longitudinal axis of the bending guide and base assembly 21. As will be hereinafter described in greater detail, particularly in connection with FIG. 8, radius of curvature 46 may vary along the longitudinal axis of the bending guide and base assembly 21, wherein the varying radius of curvature 46 decreases in length along the longitudinal axis of the bending guide and base assembly 21 from the lower end 47 to the upper end 48 of the curved bend control surface 40.

Still with reference to FIGS. 2 and 3, it is seen that a typical submerged flowline 49 which transmits hydrocarbons from a conventional offshore wellbore (not shown) is connected to a connector flowline 28 associated with the production riser assembly 20, as by a flanged connection 50. The controlled bending guide and base assembly 21 is provided with at least one connector flowline 28, and preferably a plurality of connector flowlines 28. Connector flowlines 28 provide fluid communication between the submerged flowline 49 and the production and storage vessel 31 via riser pipe flowlines 51 disposed within riser pipe 27. As shown in FIGS. 2 and 3, connector flowlines 28 may be spirally mounted in a spaced relationship about the longitudinal axis of the bending guide and base assembly 21 and the connector flowlines 28 extend from the base 35 of the guide and base assembly 21 to the riser pipe 27. The spiral connector flowlines 28 may preferably enter the interior of riser pipe 27 and be connected to the riser pipe flowlines 51 as by suitable individual flowline connectors 52 disposed within riser pipe 27. A remotely operable riser pipe connector 53 may be provided to allow riser pipe 27 to be joined to the controlled bending guide and base assembly 21 after it has been lowered into place upon base 35. As illustrated in FIGS. 1–3, tension and bend shaft member 26 may comprise a single elongate shaft member, which could either be a single cylindrical rod member or a single tubular member, or it may comprise a plurality of rod members, as will be hereinafter described in greater detail.

With reference now to FIGS. 4–6, another embodiment of the production riser assembly 20 is shown, wherein tension and bend shaft member 26 comprises a single elongate shaft member which is a single cylindrical rod member. At least one connector flowline 28, and preferably a plurality of connector flowlines 28, are mounted about the tension and bend shaft member 26 with the longitudinal axis of the connector flowline 28 and the tension and bend shaft member 26 being substantially parallel. At the upper end 42 of tension and bend shaft member 26, a suitable annular end member 55 is fixedly secured to the tension and bend shaft member 26, as by welding, and the end member 55 is in turn fixedly secured to the interior of riser pipe 27, as by welding. End member 55 is provided with a plurality of openings through which the connector flowlines 28 pass upwardly to individual flowline connectors 56, which in turn connect the connector flowlines 28 to the riser pipe flowlines 51. A plurality of spaced connector flowline spacer bearings 57 are provided to maintain the positions of the connector flowlines 28 with respect to the tension and bend shaft member 26 and to protect the connector flowlines 28 from damage through contact with the inner surface 40 of bending control cone 41, or the curved bend control surface 24 of controlled bending guide and base assembly 21, upon tension and bend shaft member 26 assuming the position shown in dotted lines due to movement of the production and storage vessel 31 (FIG. 1) and/or riser pipe 27.

Figure 12:
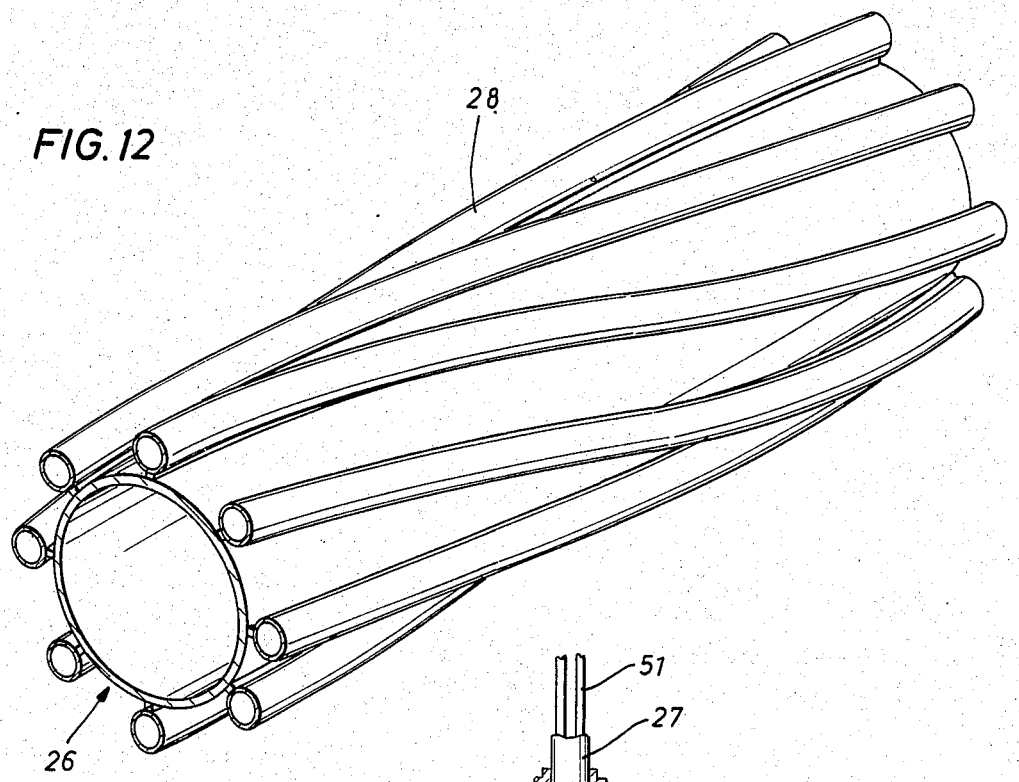
FIG. 12 is a perspective view of a portion of a tension and bend shaft member in accordance with the present invention.

It should be noted that as shown in FIG. 12, the at least one connector flowline 28, and preferably a plurality of connector flowlines 28, may be spiraled about the tension and bend shaft member 26 and are fixedly secured to the tension and bend shaft member 26. As shown in FIG. 12, the tension and bend shaft member 26 may comprise a relatively large diameter elongate tubular member. If desired the tension and bend shaft member 26 and connector flowlines 28 shown in FIG. 12 may also be provided with similar connector flowline spacer bearings 57 as shown in FIGS. 4–6. As will be hereinafter described in greater detail, the spiraling of the connector flowlines 28 as shown in FIGS. 2, 3, and 12 permits the connector flowlines 28 to flex as required by the movement of tension and bend shaft member 26 with no danger of overstressing the connector flowlines 28.

Figure 7:
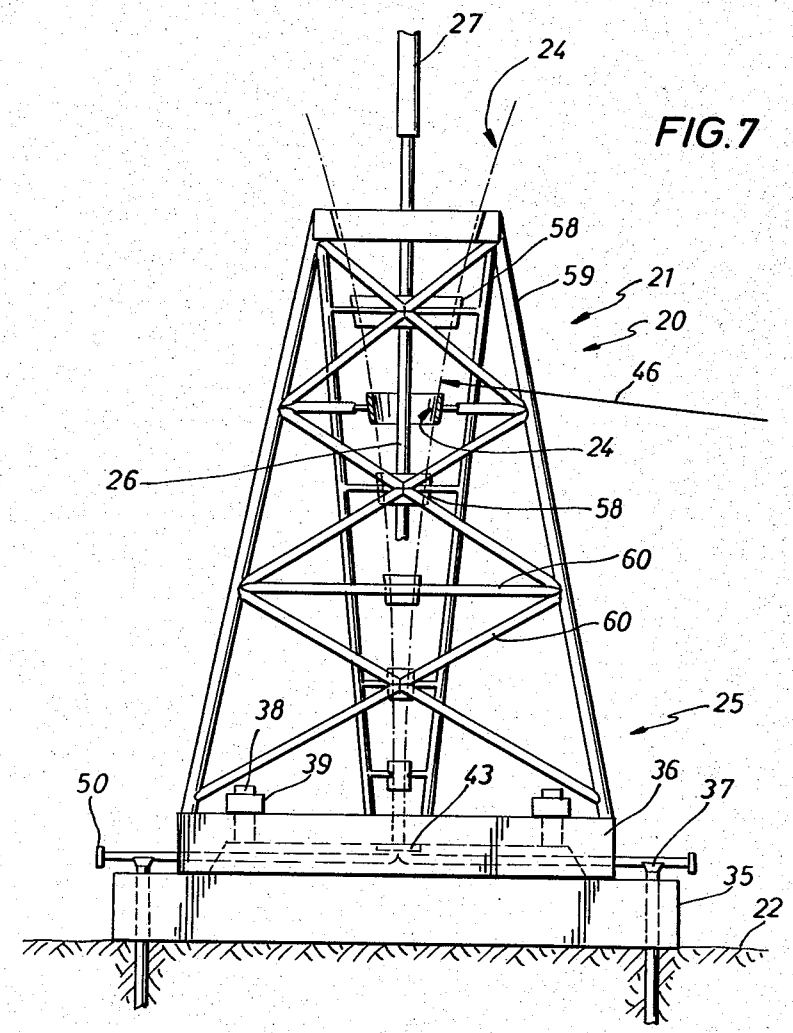
FIG. 7 is a partial cross-sectional view of another embodiment of the controlled bending guide and base assembly for use in a production riser assembly in accordance with the present invention.

Turning now to FIG. 7, it is seen that a plurality of vertically spaced conical restraining rings 58 may be fixedly secured to the guide and base assembly 21 to form the curved bend control surface 24. Guide and base assembly 21 may preferably comprise a fabricated tower structure 59 provided with suitable cross-bracing 60 to provide sufficient strength and rigidity for the tower 59 and to provide support for the conical restraining rings 58. Thus, curved bend control surface 24 has a radius of curvature as shown by arrow 46. The remaining components of the production riser assembly 20 in FIG. 7 are the same as those previously described and bear the same reference numerals of the other embodiments. It should be noted that the open structure of tower 59 eliminates the use of the debris cover 45 (FIGS. 2, 3 and 4). The tension and bend shaft member 26 and connector flowlines 28 (not shown) may be of any suitable construction as previously described, or of a type that will be hereinafter described in connection with FIGS. 9 and 10. Additionally, connector flowlines 28 may be disposed with respect to tension and bend shaft member 26 in any manner such as previously described in connection with FIGS. 2, 3, 4, or 12. Tension and bend shaft member 26 is disposed within conical rings 58. The conical rings 58 are equivalent to the bending control cone 41, previously described in connection with FIG. 3, and control the bending and movement of the tension and bend shaft member 26. Although the curved bend control surface 24 formed by the conical rings 58 is not continuous, the plurality of conical restraining rings 58 does provide the necessary barrier to limit the bending of the tension and bend shaft member 26. Also, as previously described, and as will be hereinafter described in greater detail, the radius of curvature 46 of the curved bending surface 24 formed by the plurality of conical restraining rings 58 may either be non-varying along the longitudinal axis of the guide and base assembly 21, or varying along the longitudinal axis of the guide and base assembly 21.

Figure 11:
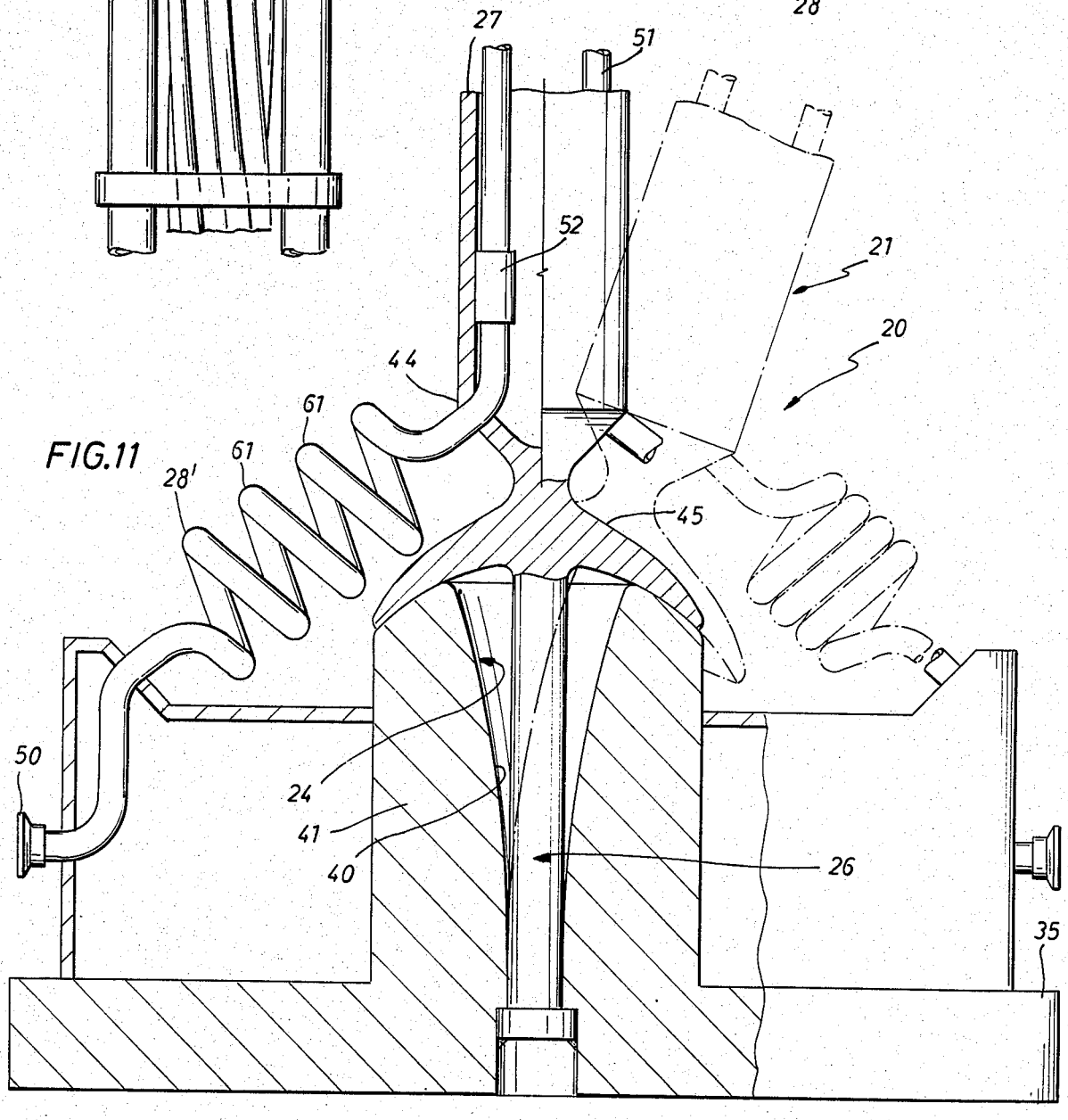
FIG. 11 is a partial cross-sectional view of another embodiment of the controlled bending guide and base assembly for use in a production riser assembly in accordance with the present invention.

With reference to FIG. 11, a production riser assembly 20 is illustrated which is similar to that previously described in connection with FIGS. 2 and 3, and accordingly common reference numerals are utilized for the components as described in FIGS. 2 and 3. In this embodiment of the guide and base assembly 21, connector flowlines 28' extend from the base 35 of the guide and base assembly 21 to the lower end 44 of riser pipe 27. A portion of the connector flowline 28' has a helical or spiral configuration 61, which provides the required flexibility in the connector flowline 28' to enable connector flowline 28' to flex upon movement of the tension and bend shaft member 26, as shown in dotted lines in FIG. 11. The diameter of the helical or spiral coils 61 would vary with the cross-sectional diameter of the connector flowline 28', so as to ensure that the maximum deflection of tension and bend shaft member 26, as shown in dotted lines, will not overstress the connector flowline 28'.

Figure 15:
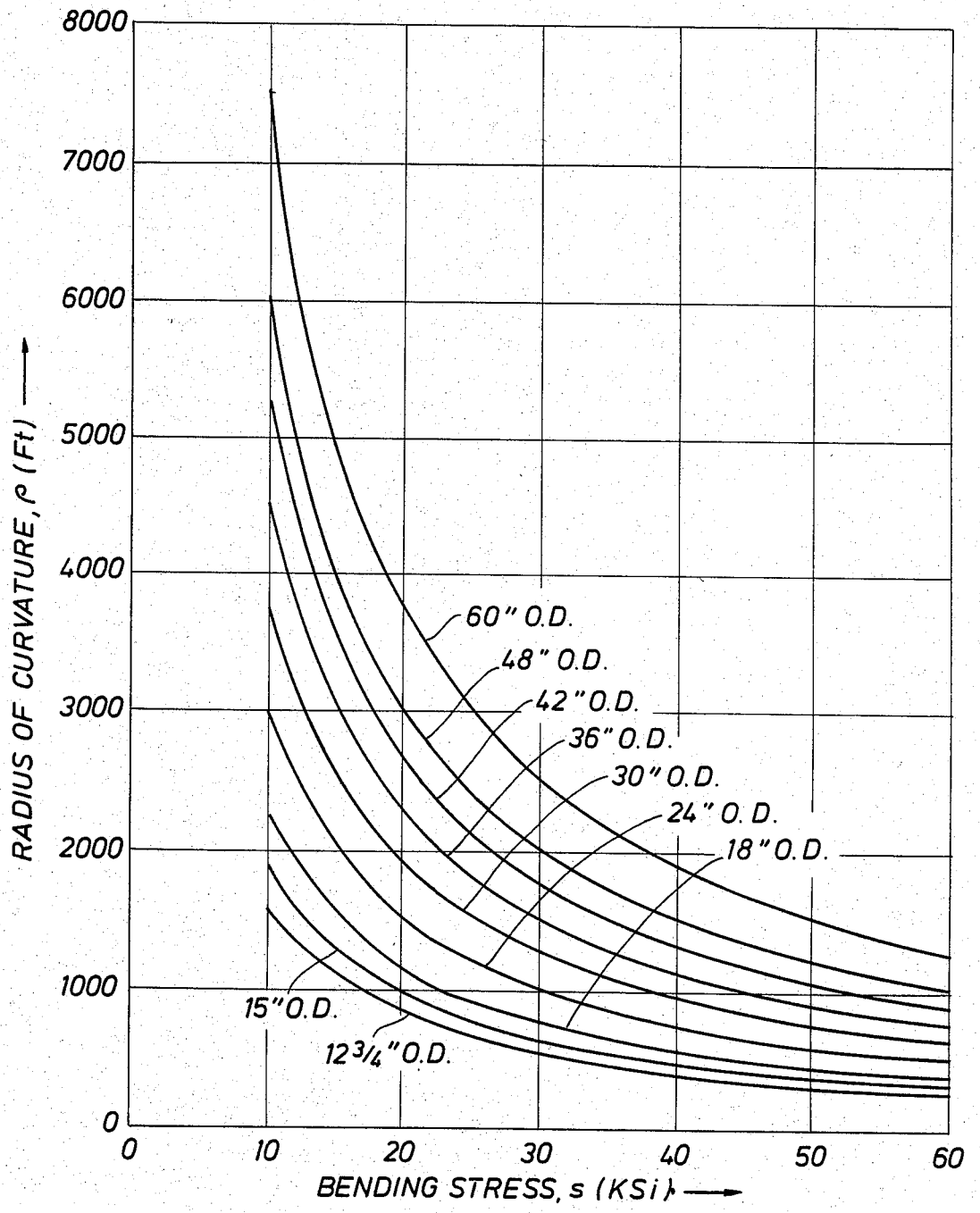
FIG. 15 is a graph illustrating bending stress plotted against radius of curvature for steel shafts of various outside diameters.

With reference now to FIGS. 1 and 15, certain design considerations of the production riser assembly 20 of the present invention will be described in greater detail. As seen in FIG. 1, the depth of the body of water is indicated by arrows d. As previously described, the angle $\theta$ indicates the amount of angular deflection by which the production and storage vessel 31 is offset from the normal vertical position shown in dotted lines in FIG. 1. The production riser assembly 20 of the present invention can be used to achieve controlled bending to almost any desired angle of deflection $\theta$, dependent upon the choice of structure utilized for the tension and bend shaft member 26 and the radius of curvature 46, or $\rho$ for curved bend control surface 24. However, it is anticipated that the deflection angle $\theta$ would not have to exceed more than approximately 10°. As an example, when the depth of the body of water, d, is approximately 4,000 feet (1,220 m.), an angle of deflection $\theta$ equal to 8° would permit approximately 560 feet (170.8 m.) of vessel offset, as shown by arrows V.O. at the upper surface 32 of the body of water 23.

In order to ensure that the tension and bend shaft member 26 is not overstressed by the bending thereof to provide 8° of deflection, the radius of curvature 46 of the curved bend control surface 24 could be a large radius. The magnitude of this radius of curvature is determined by the diameter of the tension and bend shaft member 26 and the allowable bending stress in the tension and bend shaft member 26. In this regard, FIG. 15 illustrates bending stress plotted against radius of curvature 46, or $\rho$, for steel shafts of various outside diameters. For example, a 12¾" (0.323 m.) outside diameter shaft bent to an 800 foot radius (244 m.) radius of curvature 46, or $\rho$, would be stressed to approximately 20,000 p.s.i. (137,800 KPa.) whereas a 15 inch (0.381 m.) outside diameter and an 18 inch (0.4575 m.) outside diameter tension and bend shaft member 26 bent to the same radius of curvature would be stressed to approximately 24,000 p.s.i. (165,360 KPa.) and 30,000 p.s.i. (206,700 KPa.) respectively.

It should be noted that the tension and bend shaft member 26 should be sufficiently flexible to permit bending against the shortest possible radius of curvature 46 in order to achieve the desired deflection angle $\theta$ through use of a controlled bending guide and base assembly 21 having the smallest possible height. It should be further noted that when the connector flowlines 28 are mounted with their longitudinal axis substantially parallel to that of the tension and bend shaft member 26, as seen in FIG. 4, the connector flowlines 28 must be able to be deflected through the same amount of angular deflection O as that of the tension and bend shaft member 26, without overstressing the connector flowlines 28.

As an example, using a radius of curvature 46, or $\rho$, equal to 800 feet (244 m.), to ensure acceptable maximum bending stresses in a 12¾" (0.323 m.) outside diameter connector flowline 28 and using a maximum desired angle of deflection $\theta$ of 8°, which provides an allowable vessel offset of 562 feet (171.41 m.) in a 4,000 foot (1,220 m.) deep body of water, the required minimum height of the controlled bending guide and base assembly 21, as shown by arrows h in FIG. 1, would be determined by the following formula:

$$h = \rho \sin\theta \quad \text{where:} \quad h = \text{height of bending guide and base assembly}$$
$$= 800 \times .1392 \quad \rho = \text{radius of curvature}$$
$$= \underline{111.34 \text{ ft. } (33.96 \text{ m.})} \quad \theta = \text{angle of deflection}$$

If the production riser assembly 20 of the present invention is utilized in a water depth of 5,000 feet (1,525 m.) and it is desired to maintain the same approximate maximum vessel offset of 525 feet (160.125 m.), the maximum angle of deflection $\theta$ becomes 6°. With an angle of deflection $\theta$ equal to 6° and utilizing an 800 foot (244 m.) radius of curvature 46, or $\rho$, the required height of the controlled bending guide and base assembly 21 would be approximately 83.6 feet (25.5 m.).

It should be noted that in order to obtain a desired angle of deflection $\theta$, angle $\theta$ decreases as the water depth increases, as expressed by the following mathematical formula:

$$\theta = \tan^{-1}\frac{V.O.}{d}$$

Where:

V.O.=vessel offset d=water depth

Thus, as the water depth increases tan $\theta$ and the angle of deflection $\theta$ both decrease. By utilizing a curved bend control surface 24 wherein the radius of curvature 46 along the longitudinal axis of the guide and base assembly 21 varies, by having the radius of curvature 46 decreasing along the longitudinal axis of the guide and base assembly 21 from the lower end to the upper end of the curved bend control surface 24, bending stress will increase with the deflection angle $\theta$. Maximum bending stress will not occur until the maximum angle of deflection $\theta$ is reached. Utilization of a curved bend control surface 24 made up of radii of curvature that decrease with the angle of deflection $\theta$ will ensure that maximum bending stress in the tension and bend control shaft 26 will not occur until maximum angle of deflection $\theta$ is reached. Thus, the bending stress will vary directly with the bending angle, or angle of deflection $\theta$.

Accordingly, during normal calm weather when vessel offset is minimal, the bending stress will be correspondingly low and will not increase unless the amount of vessel offset increases. Thus, the maximum bending stress will not occur in the tension and bend shaft member 26 until a storm, or other forces exerted upon the production and storage vessel 31 or riser pipe 27, moves the production and storage vessel 31 to the maximum angle of deflection $\theta$. Since the bending stress varies inversely with the radius of curvature $\theta$, a varying radius of curvature $\theta$ will keep bending stresses lower during most of the life of the production riser system 20 of the present invention, particularly in mild environment areas, where vessel offset is normally small.

With reference now to FIG. 8, the concept of utilizing a varying radius of curvature 46 or $\rho$ for the curved bend control surface 24 will be described in greater detail. It should be noted that the largest radius of curvature, $\rho_1$ is at the lower end 47 of the curved bend control surface 24 and is constant for $\theta_1$; $\rho_2$, through $\theta_2$, is shorter than $\rho_1$; $\rho_3$ through $\theta_3$, is shorter than $\rho_2$; and $\rho_4$ through $\theta_4$, is shorter than $\rho_3$. The following mathematical expressions permit the calculation of X and Y coordinates to define the radii of curvature profile and to determine the height of the controlled bending guide and base assembly 21 for various combinations of radii of curvature, $\rho_{1\text{-}n}$, and angles of deflection $\theta$, with the symbols appearing below corresponding to the reference letters of FIG. 8.

$$X_1 = AO - AN' = AN - AN\cos\theta = \rho_1 - \rho_1\cos\theta_1$$

$$X_2 = AO - AC - BQ = \rho_1 - (\rho_1 - \rho_2)\cos\theta_1 - \rho_2\cos(\theta_1 + \theta_2)$$

$$X_3 = AO - AC - BD - EG = \rho_1 - (\rho_1 - \rho_2)\cos\theta_1 - (\rho_2 - \rho_3)\cos(\theta_1 + \theta_2) - \rho_3\cos(\theta_1 + \theta_2 + \theta_3)$$

$$X_4 = AO - AC - BD - EG - FH = \rho_1 - (\rho_1 - \rho_2)\cos\theta_1 - (\rho_2 - \rho_3)\cos(\theta_1 + \theta_2) - (\rho_3 - \rho_4)\cos(\theta_1 + \theta_2 + \theta_3) - \rho_4\cos(\theta_1 + \theta_2 + \theta_3 + \theta_4)$$

$$Y_1 = NN' = AN\sin\theta_1 = \rho_1\sin\theta_1$$

$$Y_2 = BC + MQ = (\rho_1 - \rho_2)\sin\theta_1 + \rho_2\sin(\theta_1 + \theta_2)$$

$$Y_3 = BC + ED + LR = (\rho_1 - \rho_2)\sin\theta_1 + (\rho_2 - \rho_3)\sin(\theta_1 + \theta_2) + \rho_3\sin(\theta_1 + \theta_2 + \theta_3)$$

$$Y_4 = BC + ED + FG + JH = (\rho_1 - \rho_2)\sin\theta_1 + (\rho_2 - \rho_3)\sin(\theta_1 + \theta_2) + (\rho_3 - \rho_4)\sin(\theta_1 + \theta_2 + \theta_3) + \rho_4\sin(\theta_1 + \theta_2 + \theta_3 + \theta_4)$$

$\rho_1$=AO=AN $\rho_2$=BM=BN $\rho_3$=EL=EM $\rho_4$=FJ

It should be noted that pursuant to the foregoing formulas that the height of the controlled bending guide and base assembly 21 is reduced drastically with reduction of the dimension for the radius of curvature $\rho$. However, the counterpoint is that the bending stresses in the bend shaft member 26, increase rapidly with the same decrease in the length of the radius of curvature $\rho$. Accordingly, assuming an 8° maximum deflection, use of a large diameter shaft member, such as 15 to 18 inches (0.381–0.4575 m.) for the tension and bend shaft member 26 will require the use of a controlled bending guide and base assembly 21 having a height in the 120 to 130 foot (36.6–39.65 m.) range in order to maintain the bending stresses within reasonable levels if a single large diameter shaft member is utilized for the tension and bend shaft member 26.

If it is desired to reduce the height of the controlled bending guide and base assembly 21, in order to maintain bending stresses within reasonable limits, it is possible to substitute the use of a plurality of smaller diameter shaft members having an equivalent cross-sectional area. Thus, with reference to FIGS. 9 and 10, it is seen that tension and bend shaft member 26 may be comprised of a plurality of cylindrical rod members 62 which are spiraled about a central cylindrical rod member 63. A plurality of connector flowline spacer bearings 57, as previously described in connection with FIG. 4, may also be provided to maintain the positions of the connector flowlines 28 and to protect the connector flowlines 28 from damage through contact with the curved bend control surface 24. Further, the connector flowline spacer bearings 57 serve to keep the spiraled rod members 62 properly spaced from each other.

Figure 9:
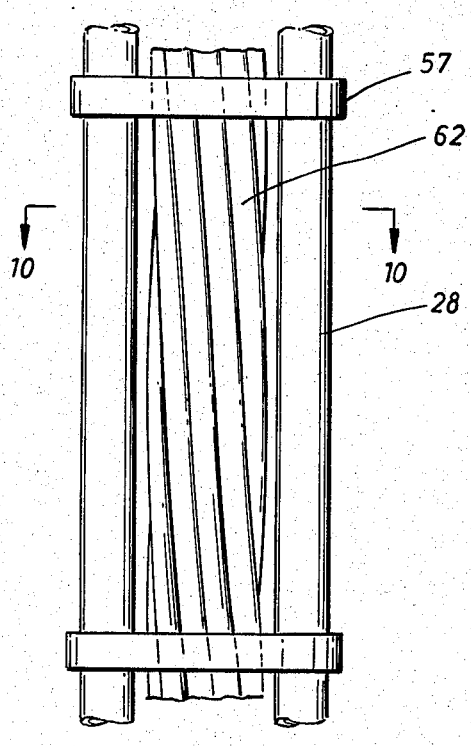
FIG. 9 is a front view of a portion of the tension and bend shaft member in accordance with the present invention.
Figure 10:
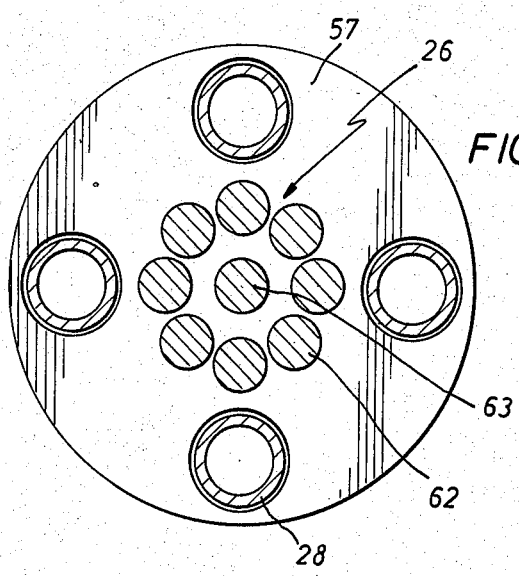
FIG. 10 is a partial cross-sectional view taken along line 10—10 of FIG. 9.

The nine rod members 62, 63 of tension and bend shaft member 26, for example, may each have a six inch diameter. Thus, they will have the same total cross-sectional area as that of a single 18 inch diameter tension and bend shaft member 26, and should have the equivalent tensile load carrying capability of such a single 18 inch diameter tension and bend shaft member 26. However, the combined rod members 62, 63 which form the tension and bend shaft member 26 will have much greater bend flexibility, which approaches the bend flexibility capability of each individual rod member. Accordingly, the use of a plurality of rod members, such as 62, 63 to form the tension and bend shaft member 26, will drastically reduce the height requirement of the controlled bending guide and base assembly 21 in which such a tension and bend shaft member 26 would be utilized. It should be noted that although FIGS. 9 and 10 illustrate the use of eight spiraled cylindrical rod members 62 disposed about a central rod member 63, many other combinations of a plurality of spiraled cylindrical rod members could be utilized. For example, spiraled layers of individual rod members could be utilized wherein one layer is provided with right-hand spiraling and the next layer is provided with left-hand spiraling. Further, any number of rod members could be utilized to form the tension and bend control shaft 26 provided the spiraled bundle of smaller diameter rod members has approximately the same total cross-sectional area as that of the required single shaft member which would provide the necessary tensile load carrying capability. Thus, if it is assumed that the spiraled bundle of small diameter rod members can be bent to the same radius of curvature as can each individual rod member in the bundle, the height of the controlled bending guide and base assembly 21 can be greatly reduced. The resulting bending moment on the controlled bending guide and base assembly will also be reduced. This height reduction will also have the benefits of reduced foundation, or base, requirements, as well as simplified installation requirements.

Figure 13:
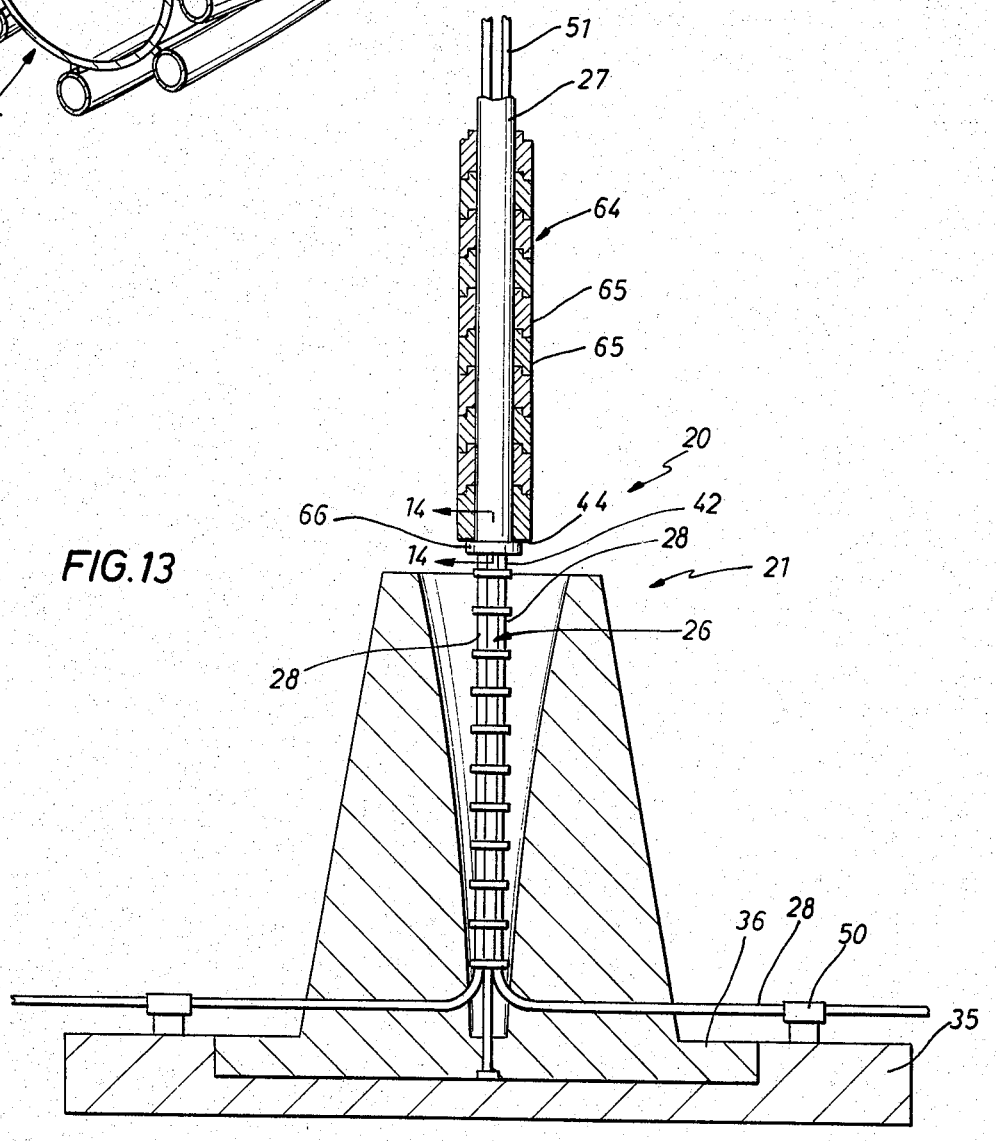
FIG. 13 is a partial cross-sectional view of another embodiment of the controlled bending guide and base assembly for use in a production riser assembly in accordance with the present invention.
Figure 14:
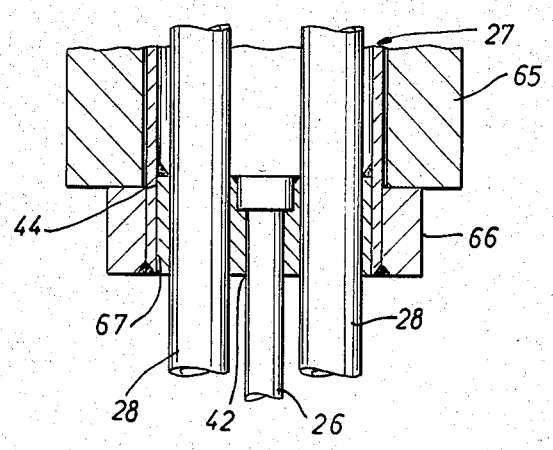
FIG. 14 is a partial cross-sectional view illustrating the details along line 14—14 of FIG. 13.

With reference now to FIGS. 13 and 14, riser pipe 27 is shown to have provided adjacent the upper end 42 of the tension and bend shaft member 26, a means for weighting 64 the lower end 44 of riser pipe 27 to remove tension forces acting upon the tension and bend shaft member 26. As previously described in connection with FIG. 1, typically a mooring buoy 29 is secured to the upper end 30 of riser pipe 27. Such a mooring buoy 29 normally exerts a substantial buoy tension load on the riser pipe 27, which tensile load is in turn exerted upon tension and bend shaft member 26. This tensile load is a significant part of the total stress forces exerted upon the tension and bend shaft member 26. If this buoy tensile load can be reduced significantly, the diameter of the tension and bend shaft member 26 can in turn be reduced. If the reduction of the tensile load is great enough, it thus becomes possible to use a smaller diameter single rod shaft, or a smaller bundle of spiraled rod members, for the tension and bend shaft member 26 and thus achieve greater flexibility. This permits the use of a shorter controlled bending guide and base assembly 21. Accordingly, by providing the lower end 44 of riser pipe 27 with a means for weighting 64, the foregoing results may be achieved.

The means for weighting may preferably comprise a plurality of annular shaped weights 65 disposed on the outer surface of riser pipe 27 which weights 65 are supported adjacent the lower end 44 of riser pipe 27 by support plate 66 welded to the exterior of riser pipe 27. Tension and bend shaft member 26 may in turn be fixedly secured to the riser pipe 27 via a plate member 67 which is welded to the interior of the lower end 44 of riser pipe 27, as shown in FIG. 14. These weights 65 could be installed after the installation of the riser pipe 27 by lowering them downwardly on the riser pipe 27 and balancing their weight on the riser pipe 27 by exhausting ballast from the mooring buoy 29 each time a weight 65 is lowered into position. The weight of the combined plurality of weights 65 should be adjusted so that there is always a nominal amount of tension force acting upon the tension and bend shaft member 26.

With reference to FIG. 1, it should be noted that the optional bend control guide 34 could operate under the same principles as those applicable to the controlled bending guide and base assembly 21 and tension and bend shaft member 26 previously described. Thus, the upper end 30 of riser pipe 27 could have fixedly secured thereto a tension and bend shaft member 26', and bend control guide 34 associated with buoy 29 would include a curved bend control surface 24' whose construction and operation is similar to those same components as previously described.

It is to be understood that the invention is not limited to the exact details of construction, operation, exact materials, or embodiment shown and described, as obvious modifications and equivalents will be apparent to one skilled in the art. Accordingly, the invention is therefore to be limited only by the scope of the appended claims.

I claim:

1. A production riser assembly for providing fluid communication between at least one flowline submerged in a body of water and a fluid storage means disposed adjacent the upper surface of the body of water, comprising:

a controlled bending guide and base assembly disposed adjacent the lower surface of the body of water and having a curved bend control surface and a base associated therewith;

a tension and bend shaft member having upper and lower ends, the lower end being fixedly secured with respect to the guide and base assembly, the shaft member being disposed adjacent the bend control surface of the guide and base assembly;

an elongate riser pipe, having upper and lower ends, the lower end being associated with the upper end of the shaft member and the upper end being associated with fluid storage means; and at least one connector flowline in fluid communication between the submerged flowline and the fluid storage means; whereby upon forces, from either the body of water or from movement of the fluid storage means, being exerted upon the riser pipe, movement of the riser pipe within the body of water is controlled by the movement of the tension and bend shaft member into an abutting relationship with a portion of the bend control surface of the guide and base assembly.

2. The production riser assembly of claim 1, wherein the curved bend control surface of the guide and base assembly has upper and lower ends and has a non-varying radius of curvature along the longitudinal axis of the guide and base assembly.

3. The production riser assembly of claim 2, wherein the curved bend control surface comprises a plurality of vertically spaced, conical restraining rings fixedly secured to the guide and base assembly and the tension and bend shaft member is disposed within the conical rings, which rings form a bending cone to control the bending and movement of the tension and bend shaft member.

4. The production riser assembly of claim 2, wherein the tension and bend shaft member comprises a single elongate shaft member.

5. The production riser assembly of claim 4, wherein the tension and bend shaft member is a single cylindrical rod member.

6. The production riser assembly of claim 4, wherein the tension and bend shaft member is a single tubular member.

7. The production riser assembly of claim 2, wherein the tension and bend shaft member comprises a plurality of spiraled cylindrical rod members.

8. The production riser assembly of claim 2, wherein the tension and bend shaft member comprises a plurality of spiraled tubular members.

9. The production riser assembly of claim 2, wherein the at least one connector flowline is spirally mounted in a spaced relationship about the longitudinal axis of the bending guide and base assembly, and the connector flowline extends from the base of the guide and base assembly to the riser pipe.

10. The production riser assembly of claim 2, wherein the at least one connector flowline is spiraled about the tension and bend shaft member and is fixedly secured thereto.

11. The production riser assembly of claim 2, wherein the at least one connector flowline extends from the base of the guide and base assembly to the riser pipe, and a portion of the connector flowline has a helical or spiral configuration.

12. The production riser assembly of claim 2, wherein the at least one connector flowline is mounted about the tension and bend shaft member with the longitudinal axis of the connector flowline and the longitudinal axis of the tension and bend shaft member being substantially parallel.

13. The production riser assembly of claim 2, wherein the riser pipe has adjacent the upper end of the tension and bend shaft member a means for weighting the lower end of the riser pipe to reduce tension forces acting upon the tension and bend shaft member.

14. The production riser assembly of claim 1, wherein the curved bend control surface of the guide and base assembly has upper and lower ends and has a varying radius of curvature along the longitudinal axis of the guide and base assembly.

15. The production riser assembly of claim 14, wherein the curved bend control surface comprises a plurality of vertically spaced conical restraining rings fixedly secured to the guide and base assembly and the tension and bend shaft member is disposed within the conical rings, which rings form a bending cone to control the bending and movement of the tension and bend shaft member.

16. The production riser assembly of claim 14, wherein the tension and bend shaft member comprises a single elongate shaft member.

17. The production riser assembly of claim 16, wherein the tension and bend shaft member is a single cylindrical rod member.

18. The production riser assembly of claim 16, wherein the tension and bend shaft member is a single tubular member.

19. The production riser assembly of claim 14, wherein the tension and bend shaft member comprises a plurality of spiraled cylindrical rod members.

20. The production riser assembly of claim 14, wherein the tension and bend shaft member comprises a plurality of spiraled tubular members.

21. The production riser assembly of claim 14, wherein the at least one connector flowline is spirally mounted in a spaced relationship about the longitudinal axis of the curved bend control surface, and the connector flowline extends from the base of the guide and base assembly to the riser pipe.

22. The production riser assembly of claim 14, wherein the at least one connector flowline is spiralled about the tension and bend shaft member and is fixedly secured thereto.

23. The production riser assembly of claim 14, wherein the at least one connector flowline extends from the base of the guide and base assembly to the riser pipe, and a portion of the connector flowline has a helical or spiral configuration.

24. The production riser assembly of claim 14, wherein the at least one connector flowline is mounted about the tension and bend shaft member with the longitudinal axis of the connector flowline and the tension and bend shaft member being substantially parallel.

25. The production riser assembly of claim 14, wherein the riser pipe has adjacent the upper end of the tension and bend shaft member a means for weighting the lower end of the riser pipe to remove tension forces acting upon the tension and bend shaft member.

26. The production riser assembly of claim 14, wherein the varying radius of curvature decreases along the longitudinal axis of the guide and base assembly from the lower end to the upper end of the curved bend control surface.

27. A controlled bending guide and base assembly for use in a production riser assembly for providing fluid communication between at least one flowline submerged in a body of water an elongate riser pipe, having upper and lower ends, the upper end thereof being in fluid communication with a fluid storage means disposed adjacent the upper surface of the body of water, comprising:

a base, having a curved bend control surface associated therewith;

a tension and bend shaft member having upper and lower ends, the lower end being fixedly associated with the base, and being disposed adjacent the bend control surface, and the upper end is free to move and is adapted to be connected to the riser pipe; and at least one connector flowline associated with the base and adapted for fluid communication between the submerged flowline and the riser pipe; whereby upon forces, from either the body of water or from movement of the fluid storage means, being exerted upon the riser pipe and transmitted to the tension and bend shaft member, movement of the riser pipe within the body of water is controlled by the movement of the tension and bend shaft member into an abutting relationship with a portion of the curved bend control surface of the base.

28. The controlled bending guide and base assembly of claim 27, wherein the curved bend control surface associated with the base has upper and lower ends and has a non-varying radius of curvature along the longitudinal axis of the tension and bend shaft member.

29. The controlled bending guide and base assembly of claim 28, wherein the curved bend control surface comprises a plurality of vertically spaced conical restraining rings fixedly secured to the base, and the tension and bend shaft member is disposed within the conical rings, which rings form a bending cone to control the bending and movement of the tension and bend shaft member.

30. The control bending guide and base assembly of claim 28, wherein the tension and bend shaft member comprises a single elongate shaft member.

31. The control bending guide and base assembly of claim 30, wherein the tension and bend shaft member is a single cylindrical rod member.

32. The control bending guide and base assembly of claim 30, wherein the tension and bend shaft member is a single tubular member.

33. The control bending guide and base assembly of claim 28, wherein the tension and bend shaft member comprises a plurality of spiraled cylindrical rod members.

34. The control bending guide and base assembly of claim 28, wherein the tension and bend shaft member comprises a plurality of spiraled tubular members.

35. The control bending guide and base assembly of claim 28, wherein the at least one connector flowline is spirally mounted in a spaced relationship about the longitudinal axis of the tension and bend shaft member, and the connector flowline extends from the base to the riser pipe.

36. The control bending guide and base assembly of claim 28, wherein the at least one connector flowline is spiraled about the tension and bend shaft member and is fixedly secured thereto.

37. The control bending guide and base assembly of claim 28, wherein the at least one connector flowline extends from the base to the riser pipe, and a portion of the connector flowline has a helical or spiral configuration.

38. The control bending guide and base assembly of claim 28, wherein the at least one connector flowline is mounted about the tension and bend shaft member with the longitudinal axis of the connector flowline and the tension and bend shaft member being substantially parallel.

39. The control bending guide and base assembly of claim 28, wherein the riser pipe has adjacent the upper end of the tension and bend shaft member a means for weighting the lower end of the riser pipe to remove tension forces acting upon the tension and bend shaft member.

40. The control bending guide and base assembly of claim 27, wherein the curved bend control surface of the base has upper and lower ends and has a varying radius of curvature along the longitudinal axis of the tension and bend shaft member.

41. The control bending guide and base assembly of claim 40, wherein the curved bend control surface comprises a plurality of vertically spaced conical restraining rings fixedly secured to base and the tension and bend shaft member is disposed within the conical rings, which rings form a bending cone to control the bending and movement of the tension and bend shaft member.

42. The control bending guide and base assembly of claim 40, wherein the tension and bend shaft member comprises a single elongate shaft member.

43. The control bending guide and base assembly of claim 42, wherein the tension and bend shaft member is a single cylindrical rod member.

44. The control bending guide and base assembly of claim 42, wherein the tension and bend shaft member is a single tubular member.

45. The control bending guide and base assembly of claim 40, wherein the tension and bend shaft member comprises a plurality of spiraled cylindrical rod members.

46. The control bending guide and base assembly of claim 40, wherein the tension and bend shaft member comprises a plurality of spiraled tubular members.

47. The control bending guide and base assembly of claim 40, wherein the at least one connector flowline is spirally mounted in a spaced relationship about the longitudinal axis of the tension and bend shaft member, and the connector flowline extends from the base of the guide and base assembly to the riser pipe.

48. The control bending guide and base assembly of claim 40, wherein the at least one connector flowline is spiraled about the tension and bend shaft member and is fixedly secured thereto.

49. The control bending guide and base assembly of claim 40, wherein the at least one connector flowline extends from the base of the guide and base assembly to the riser pipe, and a portion of the connector flowline has a helical or spiral configuration.

50. The control bending guide and base assembly of claim 40, wherein the at least one connector flowline is mounted about the tension and bend shaft member with the longitudinal axis of the connector flowline and the tension and bend shaft member being substantially parallel.

51. The control bending guide and base assembly of claim 40, wherein the riser pipe has adjacent the upper end of the tension and bend shaft member a means for weighting the lower end of the riser pipe to remove tension forces acting upon the tension and bend shaft member.

52. The control bending guide and base assembly of claim 40, wherein the varying radius of curvature decreases along the longitudinal axis of the tension and bend shaft member from the lower end to the upper end of the tension and bend shaft member.

* * * * *